United States Patent [19]

Alten

[11] 4,175,608

[45] Nov. 27, 1979

[54] CLOSURE STRUCTURE, ESPECIALLY FOR OPENINGS IN A BUILDING

[76] Inventor: Kurt Alten, Ringstr. 14, 3015 Wennigsen, Fed. Rep. of Germany

[21] Appl. No.: 877,750

[22] Filed: Feb. 14, 1978

[30] Foreign Application Priority Data

Feb. 15, 1977 [DE] Fed. Rep. of Germany ..... 2706233

[51] Int. Cl.[2] ..... E06B 9/20

[52] U.S. Cl. ..... 160/273 R

[58] Field of Search ..... 160/11, 273 R, 310

[56] References Cited

U.S. PATENT DOCUMENTS

| | | | |
|---|---|---|---|
| 1,922,389 | 8/1933 | Nye | 160/273 R |
| 2,876,471 | 3/1959 | Kraemer | 160/11 |
| 3,421,568 | 1/1969 | Youngs | 160/310 |

FOREIGN PATENT DOCUMENTS

| | | | |
|---|---|---|---|
| 243295 | 2/1912 | Fed. Rep. of Germany | 160/11 |

*Primary Examiner*—Peter M. Caun

*Attorney, Agent, or Firm*—Becker & Becker, Inc.

[57] ABSTRACT

A closure structure especially for openings in a building, in which a flexible closure member (e.g. a door) is laterally guided in substantially vertical guides and is prevented from accidentally slipping out of the vertical guides by means of latching members, e.g. steel balls, which during the downward movement of the closure member are released through a discharge opening of a magazine into and through a passage in the closure member and into the respective adjacent guide. In response to the upward movement of the closure member, the latching members are returned to the magazine and stored therein. The upward movement of the closure member is brought about by winding the latter up upon a reel, and the downward movement of the closure member is brought about by winding the closure member off the reel.

16 Claims, 9 Drawing Figures

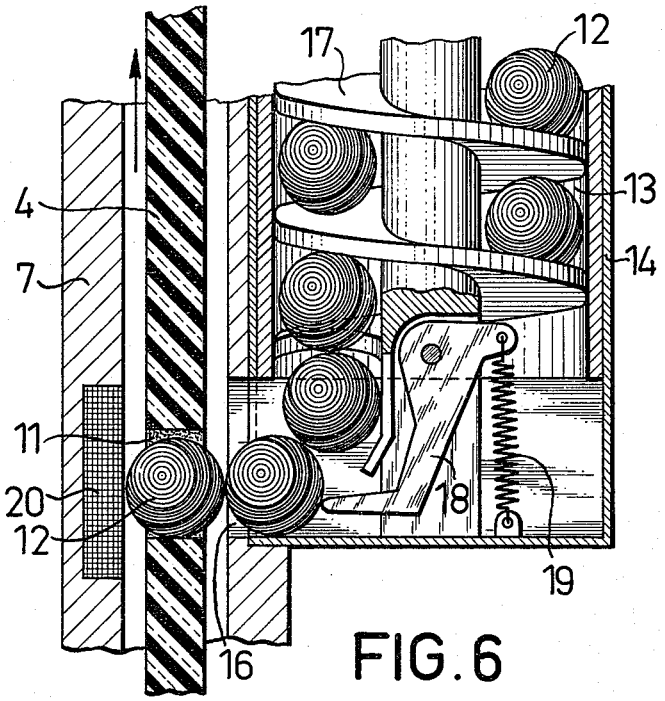
FIG. 6
FIG. 8
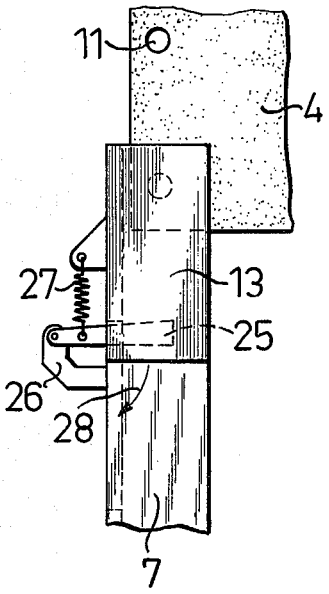
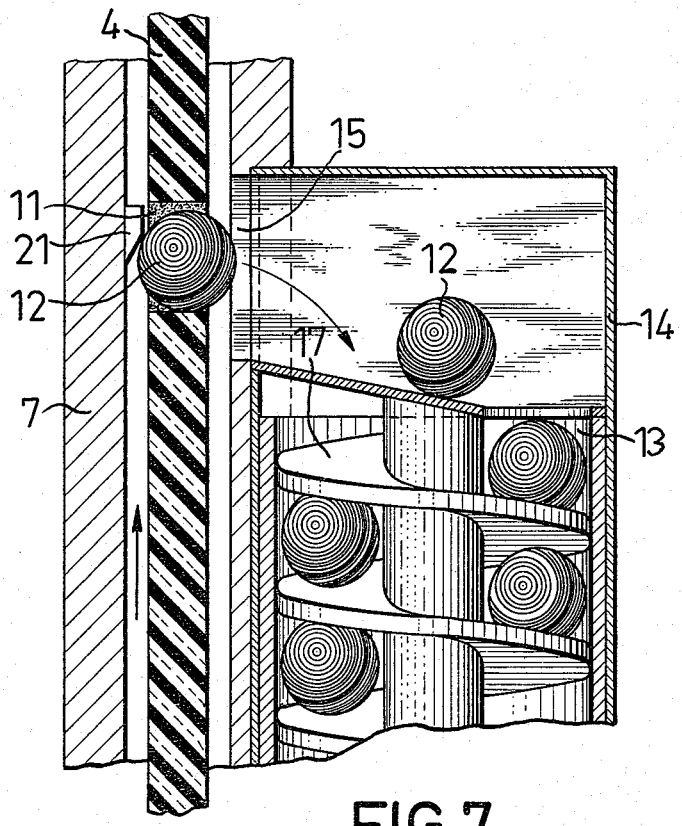
FIG. 7
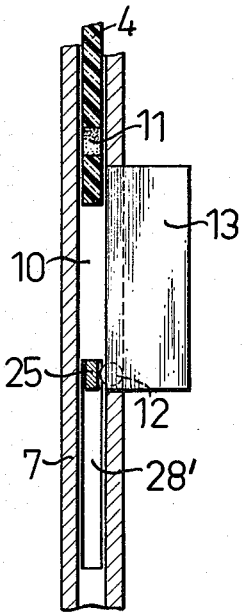
FIG. 9

CLOSURE STRUCTURE, ESPECIALLY FOR OPENINGS IN A BUILDING

The present invention relates to a rolling door, a rolling gate, a shutter and the like with a closure body adapted to be lifted and lowered by a winding up and winding off action, said closure body being operable to close the respective opening and being secured against accidentally leaving its lateral guides. With heretofore known devices of this type, the means for instance projecting hooks bringing about the sliding out action are firmly connected to the closure body. As a result thereof, considerable space is necessary for winding up the closure body, and also a correspondingly designed rolling up bracket (Wickelbock) is necessary.

It is, therefore, an object of the present invention to improve the above mentioned rolling doors, rolling gates, shutters and the like in such a way that the closure body can be wound up to a roll of a relatively small diameter.

It is a further object of the invention to provide devices of this type, especially windable closure bodies for rolling doors, rolling gates, shutters and the like which can be designed as a thin-walled flexible plate.

These and other objects and advantages of the invention will appear more clearly from the following specifications in connection with the accompanying drawings, in which.

Figure 1:
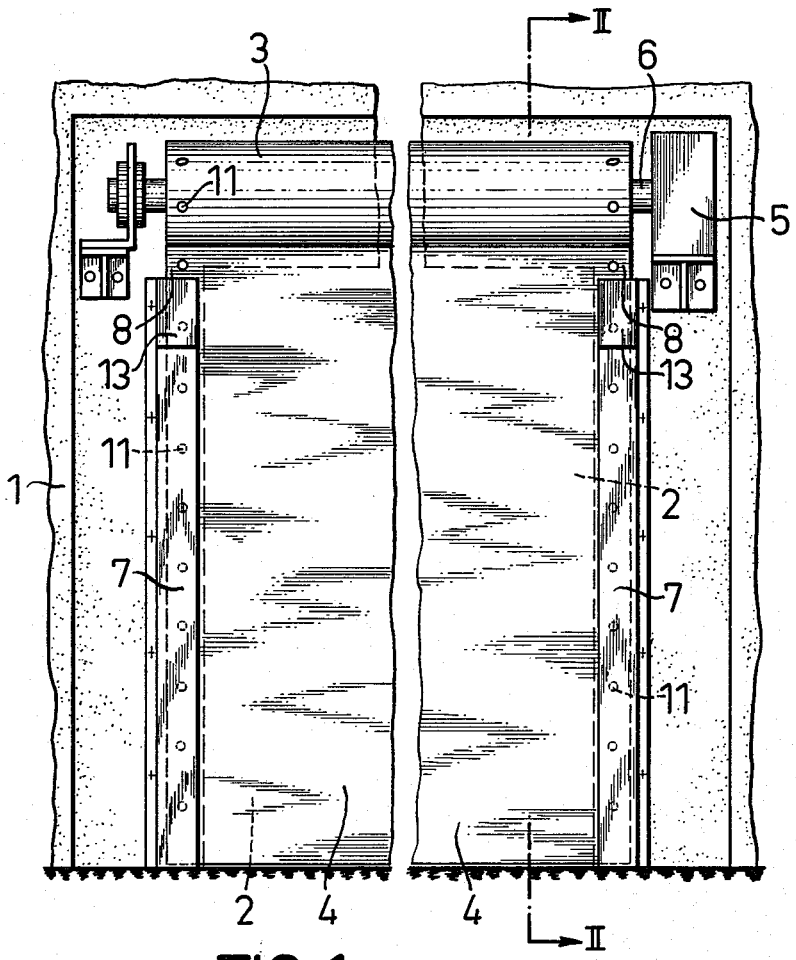
FIG. 1 is a rolling gate in its effective position, and more specifically represents an inside view of the gate.

FIGS. 4–7 respectively represent a vertical section through the magazine for receiving the securing elements, the device being shown in different positions of operation of the closure body.

FIGS. 8 and 9 illustrate further details of the arrangement according to the invention.

The closure arrangement with a closure body adapted to be wound up and off according to the invention is characterized primarily in that the securing elements are detachably connected to the rim portions of the closure body, are adapted to be conveyed to the closure body to be wound off, and are adapted to be withdrawn from the closure body to be wound off.

This detachable connection of the securing elements has the advantage that the closure body can be wound off without its securing elements. As a result thereof, the closure body can be wound off with a relatively small winding diameter and with the windings closely engaging each other. Thus, the rolled up closure member requires a minimum of space. Expediently, a magazine is provided for the securing elements. This magazine is provided for receiving the securing elements during the winding up operation of the closure body and for releasing the securing elements to the closure body when the latter is being wound off, has to function during the operation of the closure body and is advantageously arranged between the rolling up bracket and the start of the lateral guides for the closure body.

The securing elements are preferably individual elements which are one after another introduced into lateral recesses of the closure body or are drawn therethrough. Particularly advantageous for this purpose are metal balls having associated therewith correspondingly large openings provided on the closure member. The dimensions of these securing elements are selected so that they project beyond the closure body so that within the lateral guides they can catch from behind a projecting edge or the like of the profile of the guides. Due to this positive connection, the desired safety and securing of the closure body is obtained. If the closure body is subjected to outer forces, it cannot be released from its lateral guides or slip off from said guides.

This design also permits the employment of plane flexible plates, for instance plates of a soft set polyvinylchloride or a similar synthetic material which can be transparent or translucent and may be used as closure body for openings in buildings or a house.

Referring now to the drawings in detail, the outer wall 1 of the building has an opening 2 which is to be closed by the illustrated roller body or gate. At the upper rim portion of the opening 2 there is provided a rolling up bracket 3 for winding up the plate shaped bendable closure body 4 of soft set polyvinylchloride. This rolling up bracket 3 can in customary manner be provided with a driving motor 5 for turning the winding up and winding off shaft 6.

At both sides of the opening 2 there is arranged a vertically extending guiding member 7 having a U-shaped cross section, for receiving and guiding the lateral rim portions 8 of the closure member 4. These guiding members 7 extend down to the lower rim portion of opening 2 on which the lower rim of the closure body 4 rests so as to close the opening 2. The guiding member 7 which is fixedly connected to the inner side of the outer wall 1 has its rear region, which faces the web 9, widened somewhat. This widening is designated with the reference number 10. The rim portion 8 which extends into said widened portion 10 has round perforations in the form of bores 11, said perforations being evenly spaced from each other. The bores 11 are provided in slightly spaced arrangement from the lateral edges of the closure body 4. In the bores 11 there are located steel balls 12 which have a diameter which amounts to about twice the wall thickness of the closure body 4. The balls 12 are located in the widened portion 10 the free width of which is slightly greater than the ball diameter. As a result of this arrangement, a positive connection is established for the marginal portions 8. Inasmuch as the balls 12 cannot leave the guide 7 toward the side and since furthermore transverse displacement between the respective ball 12 and the closure body 4 cannot occur, the closure body 4 is safely secured against slipping out of the guide member 7. Mechanical forces acting upon said closure body 4 will thus not be able to cause the closure body 4 to leave its lateral guides.

At the upper end of the guide 7, slightly below the rolling up bracket 3, there is provided a magazine 13 for receiving the balls 12. This magazine comprises a box-shaped housing 14, an upper entrance opening 15, a lower exit opening 16, and a spiral chute 17 which increases the receiving capacity of the magazine 13. A lever 18 extends into the region of the outlet opening 16 and is preloaded by a spring 19.

If the opening 2 is to be closed by winding off the closure body 4, the bores 11 will one after another line up with the magazine 13.

Figure 3:
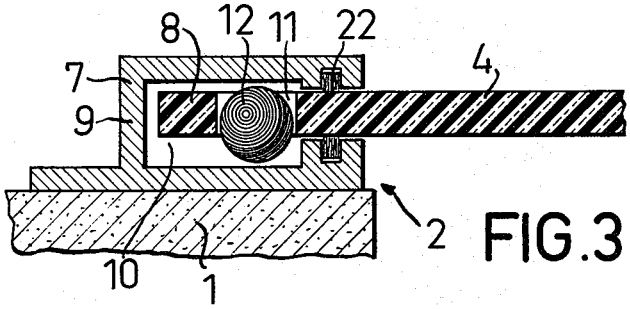
FIG. 3 illustrates a section taken along the line III—III of FIG. 2.
Figure 4:
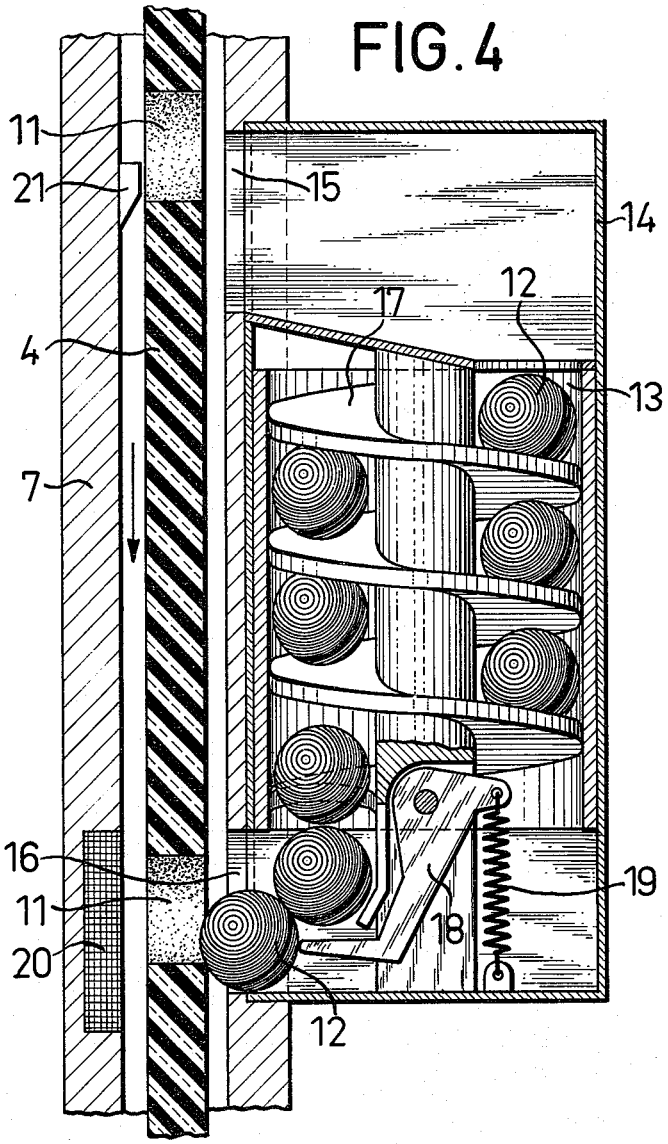
Figure 5:
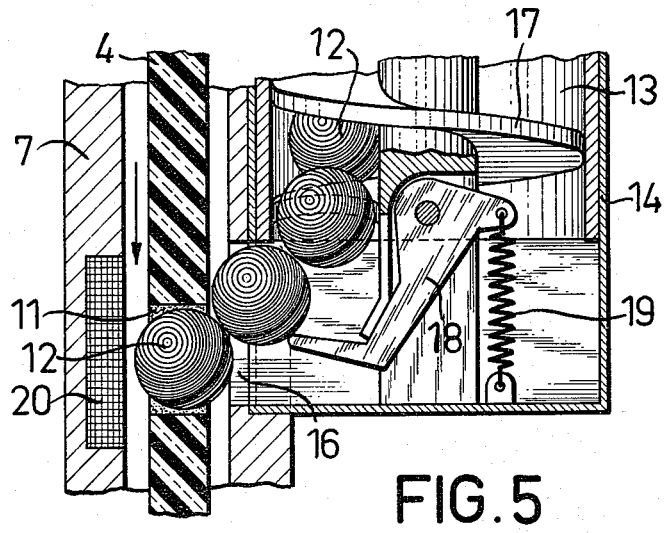

According to FIG. 4, the lower ball 12 occupies its standby position but is already under the influence of the lever 18 which latter due to being preloaded by spring 19 tends to transversely push off the ball 12. If now the bore 11 due to a further lowering of the closure body 4, is in alignment with the lower ball 10, the latter will be pushed by lever 18 through adjacent bore 11. During a further lowering movement of the closure body 4, the last mentioned ball 12 is carried along and brings about the latching action as shown in FIG. 3. The next following ball 12, however, can leave the magazine 13 only when the next following bore 11 lines up with the outlet opening 16. The feeding of the closure body 4 with the balls 12 can be accelerated by magnets 20 arranged on a leg of the profile of guide 7.

Figure 2:
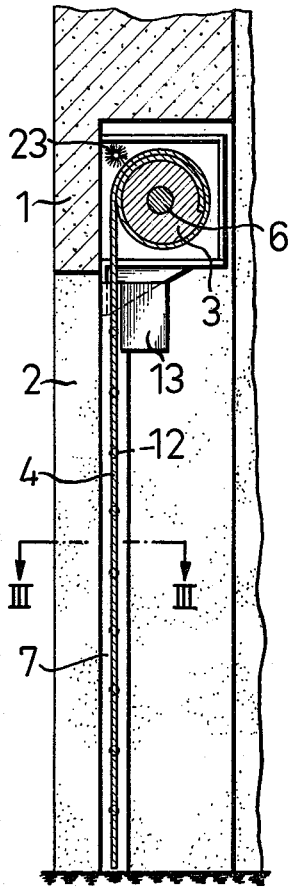
FIG. 2 is a section taken along the line II—II of FIG. 1.

After the closure body 4 has reached its final effective position shown in FIGS. 1 and 2, all bores 11 are loaded.

When the rolling guide is to be opened, the balls 12 are lifted during the winding up of the closure body 4 and are one after another moved in front of an ejector on guide 7, said ejector preferably having the shape of a cam 21 which represents a restriction and thus forces the balls 12 one after another to pass through the opening 15 into the magazine 13. When the gate is open, all balls 12 will be in the magazine 13.

The closure body 4 in its wound-up condition is free from the balls 12 and has only a relatively small diameter. The rolled up body therefore occupies a rather small space, and the arrangement according to the invention is therefore highly space saving.

In order to assure that a good seal is obtained and a soiling also in the region of the bores 11 will not occur, an advantageously rotatable cleaning brush 23 may be provided between the rolled up closure body and the magazine 13. To this end, there are provided brushes 22 which are located at the free end of the legs of the guides 7 and which act on both sides upon the plate-shaped closure body 4.

FIG. 8 shows the roller gate according to FIG. 1 in opened position and more specifically illustrates a fragmentary view within the region of the magazine located at the left upper side of FIG. 8. In order to prevent the magazine 13 from actually emptying out when the closure body 4 is in its pulled up position, and furthermore in order to make it possible that the structural height at the upper end of the roller gate is kept as small as possible, the exit opening 16 of the magazine 13 has associated therewith a self-acting closure which keeps this opening closed when the lower rim portion of the closure body 4 is located above the exit opening 16. To this end, a lever 25 is provided which is located in front of the exit opening. The lever 25 is arranged laterally outwardly on an arm 26 and is held in its closed position by a tension spring 27. However, when the closure body is being lowered, the lever 25 is grasped by the lower rim of the closure body 4, and by pivoting in the direction of the arrow 28 frees the exit opening 16 so that the lever 25 can move into a slot 28'. When this position has been reached, the balls 12 can unimpededly leave the magazine 13. Prior to reaching the upper end position of the closure body 4, the spring 27 becomes effective. The lever 25 is again pulled upwardly into the closing position. It is a matter of course that also similar closure means and other elements can be employed which bring about a return of the closure means into the closing position.

Instead of a rigid cam 21, also an elastically yieldable abutment may be provided for instance a leafspring which in the manner of cam 21 projects forwardly.

It may also be mentioned that FIG. 9 represents a vertical fragmentary section through the detail of FIG. 8 and more specifically viewed in the direction towarc the closed end of the guide 7.

It is, of course, to be understood that the present invention is, by no means, limited to the specific showing in the drawings, but also comprises any modifications within the scope of the appended claims.

What I claim is:

1. A closure structure especially for buildings, which includes: wall means comprising two substantially parallel vertical side wall sections spaced from each other in horizontal direction, and also comprising at least one horizontal wall section interconnecting said vertical side wall sections and defining therewith a wall opening, a closure member movable selectively upwardly and downwardly for respectively opening and closing said wall opening, lateral guiding means connected to said side walls for laterally guiding said closure member, said closure member having transverse passage means therethrough, latching means operable during the downward movement of said closure member from the outside of said guiding means to enter said transverse passage means and through the latter partly to enter said guiding means for cooperation with said guiding means to prevent said closure member to slip out of said guiding means, and means associated with said guiding means and operable in response to the upward movement of said closure member to bring about removal of said latching means from said passage means and said guiding means, motor driven reel means located near the upper end of said wall opening for winding said closure member up and off said reel means, a magazine arranged between said reel means and the upper end of one of said lateral guiding means for receiving and releasing said latch means, said magazine having an upper section with an entrance opening into said magazine, a stationary ejector arranged on said guiding means opposite said last mentioned opening for feeding latching means from said closure member into said magazine, said magazine having a lower section with a discharge opening for the latching means in said magazine, said magazine also being provided with a spiral chute leading from said entrance opening to said discharge opening, and said discharge opening having associated therewith a closing element normally closed and adapted to be opened in response to the downward movement of said closure member.

2. A closure structure according to claim 1, in which said closing element is by the lower end of said closure member displaceable from a closed position into an open position.

3. A closure structure according to claim 1, in which said closing element is a spring-loaded lever pivotable against the thrust of a return spring.

4. A closure structure according to claim 1, in which said closure member forms a flexible plate.

5. A closure structure according to claim 1, in which said guiding means include a projection to latchingly engage said latching means in response to the latter having passed through said passage means into said guiding means.

6. A closure structure according to claim 1, in which the thickness of said latching means exceeds the thickness of said closure member.

7. A closure structure according to claim 1, in which said guiding means has a U-shaped cross section, and in which the distance between the free ends of the legs of said U-shaped cross section only slightly in accordance with the respective guiding tolerance exceeds the thickness of that portion of said closure member which is straddled by said guiding means, that portion of said cross section which is located near said passage means being widened to receive a portion of said latching means.

8. A closure structure according to claim 7, which includes scraping means adjacent said reel means for exerting a cleaning action upon the closure member while it is reeled up and off.

9. A closure structure according to claim 8, in which said scraping means includes a rotatable brush.

10. A closure structure according to claim 1, in which said latching means are formed by wear resistant balls.

11. A closure structure according to claim 1, in which said stationary ejector is a cam.

12. A closure structure according to claim 11, in which said cam is elastically yieldable.

13. A closure structure according to claim 12, in which said cam is a cam-shaped leafspring.

14. A closure structure especially for buildings, which includes: wall means comprising two substantially parallel vertical side wall sections spaced from each other in horizontal direction, and also comprising at least one horizontal wall section interconnecting said vertical side wall sections and defining therewith a wall opening, a closure member movable selectively upwardly and downwardly for respectively opening and closing said wall opening, lateral guiding means connected to said side walls for laterally guiding said closure member, said closure member having transverse passage means therethrough, latching means operable during the downward movement of said closure member from the outside of said guiding means to enter said transverse passage means and through the latter partly to enter said guiding means for cooperation with said guiding means to prevent said closure member to slip out of said guiding means, and means associated with said guiding means and operable in response to the upward movement of said closure member to bring about removal of said latching means from said passage means and said guiding means, motordriven reel means located near the upper end of said wall opening for winding said closure member up and off said reel means, a magazine arranged between said reel means and the upper end of one said lateral guiding means for receiving and releasing said latch means, said magazine having an upper section with an entrance opening into said magazine, a stationary ejector arranged on said guiding means opposite said last mentioned opening for feeding latching means from said closure member into said magazine, said magazine having a lower section with a discharge opening for the latching means in said magazine, said magazine also being provided with a spiral chute leading from said entrance opening to said discharge opening, and feeder means associated with said discharge opening and continuously urging one latching means at a time to move into said discharge opening for stand-by.

15. A closure structure especially for buildings, which includes: wall means comprising two substantially parallel vertical side wall sections spaced from each other in horizontal direction, and also comprising at least one horizontal wall section interconnecting said vertical side wall sections and defining therewith a wall opening, a closure member movable selectively upwardly and downwardly for respectively opening and closing said wall opening, lateral guiding means connected to said side walls for laterally guiding said closure member, said closure member having transverse passage means therethrough, latching means operable during the downward movement of said closure member from the outside of said guiding means to enter said transverse passage means and through the latter partly to enter said guiding means for cooperation with said guiding means to prevent said closure member to slip out of said guiding means, and means associated with said guiding means and operable in response to the upward movement of said closure member to bring about removal of said latching means from said passage means and said guiding means, motor driven reel means located near the upper end of said wall opening for winding said closure member up and off said reel means, a magazine arranged between said reel means and the upper end of one of said lateral guiding means for receiving and releasing said latch means, said magazine having an upper section with an entrance opening into said magazine, a stationary ejector arranged on said guiding means opposite said last mentioned opening for feeding latching means from said closure member into said magazine, said magazine having a lower section with a discharge opening for the latching means in said magazine, said magazine also being provided with a spiral chute leading from said entrance opening to said discharge opening, and magnetic means arranged in said guiding means opposite said discharge opening in said magazine to aid the transfer of latching means from said magazine into said closure member and said guiding means.

16. A closure structure according to claim 13, in which said feeder means are spring loaded.

* * * * *